US006089829A

United States Patent [19]

Gestermann et al.

[11] Patent Number: 6,089,829

[45] Date of Patent: Jul. 18, 2000

[54] PUMP FOR HOT CORROSIVE MELTS

[75] Inventors: Fritz Gestermann, Leverkusen; Hans-Georg Janssen; Willi Potes, both of Köln; Heiko Herold, Neuss, all of Germany

[73] Assignee: Bayer Aktiengesellschaft, Leverkusen, Germany

[21] Appl. No.: 09/068,854

[22] PCT Filed: Nov. 8, 1996

[86] PCT No.: PCT/EP96/04897

§ 371 Date: May 19, 1998

§ 102(e) Date: May 19, 1998

[87] PCT Pub. No.: WO97/19270

PCT Pub. Date: May 29, 1997

[30] Foreign Application Priority Data

Nov. 21, 1995 [DE] Germany ..... 195 43 325

[51] Int. Cl.[7] ..... F04F 1/06

[52] U.S. Cl. ..... 417/118; 417/126; 417/424.1; 137/512.3

[58] Field of Search ..... 417/118, 126, 417/424.1; 137/512.3

[56] References Cited

U.S. PATENT DOCUMENTS

| | | | |
|---|---|---|---|
| 1,409,346 | 3/1922 | Kobel | 417/118 |
| 1,499,589 | 7/1924 | Navin | 417/118 |
| 2,142,482 | 1/1939 | Stephens et al. | 417/118 |
| 5,074,758 | 12/1991 | McIntyre | 417/138 |
| 5,203,681 | 4/1993 | Cooper | 417/424.1 |
| 5,569,024 | 10/1996 | Dummbersdorf et al. | 417/420 |
| 5,611,671 | 3/1997 | Tripp, Jr. | 417/126 |
| 5,628,624 | 5/1997 | Nelson, II | 417/456 |
| 5,660,810 | 8/1997 | Dummersdorf et al. | 423/502 |

FOREIGN PATENT DOCUMENTS

| | | | |
|---|---|---|---|
| 1000076A7 | 2/1988 | Belgium . | |
| 1124528 | 10/1956 | France . | |
| 2220776 | 10/1974 | France | G01F 11/28 |
| 2258124 | 5/1974 | Germany | F04F 1/08 |
| 2543848 | 4/1977 | Germany | F04F 1/06 |

*Primary Examiner*—Henry Bennett
*Assistant Examiner*—Mark Shulman
*Attorney, Agent, or Firm*—Norris, McLaughlin & Marcus, P.A.

[57] ABSTRACT

The invention relates to a pump for discharging hot corrosive liquids, in particular molten salts, consisting of a pump pipe (1), a discharge pipe (2) dipping into the liquid and at least two valves (3, 4), whereby the liquid is discharged periodically by pressurisation.

5 Claims, 4 Drawing Sheets

PUMP FOR HOT CORROSIVE MELTS

Figure 1:
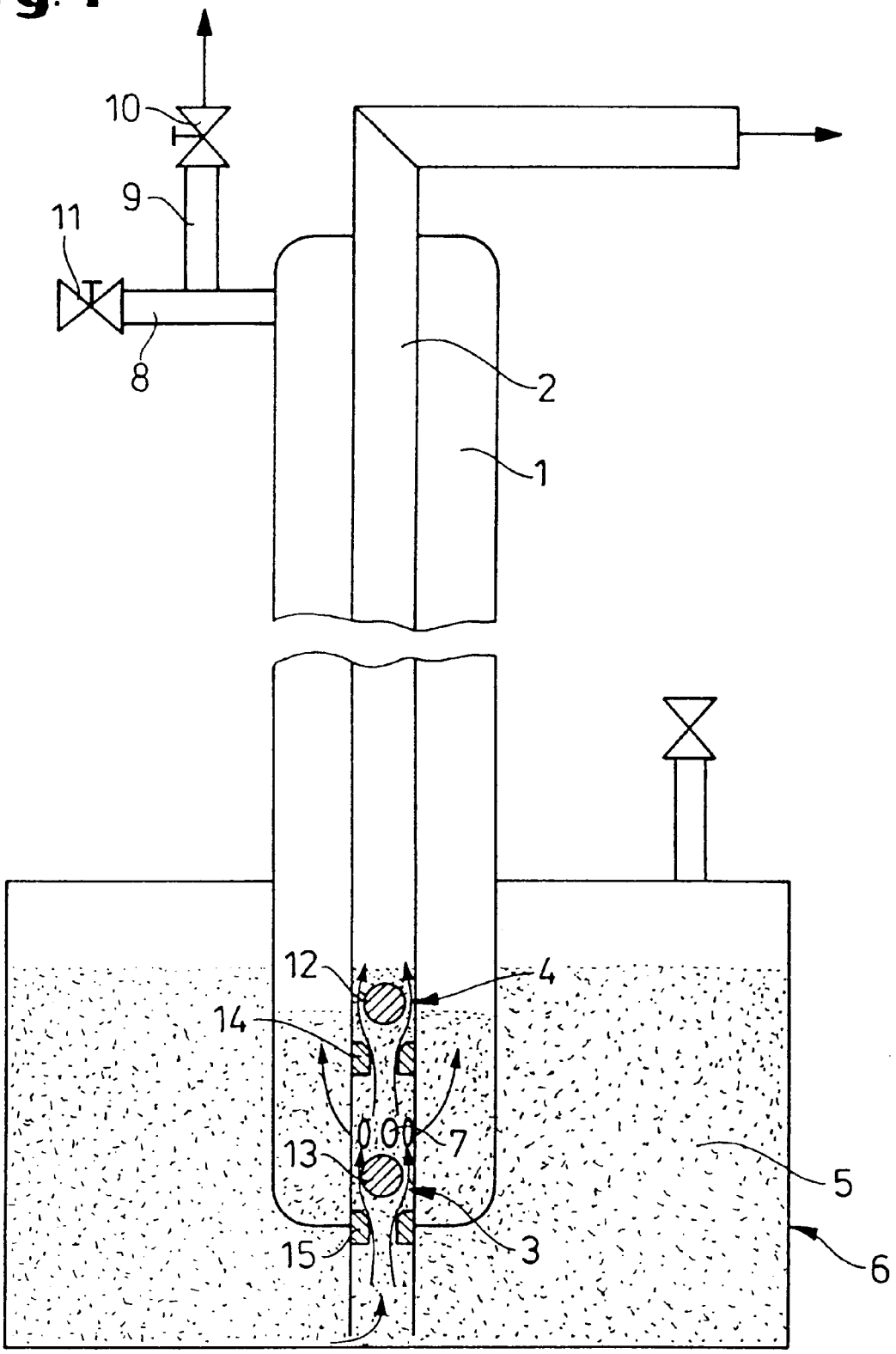

The invention relates to a pump for discharging hot corrosive liquids, in particular molten salts, consisting of a pump pipe, a discharge pipe dipping into the liquid and at least two valves whereby the liquid is discharged periodically by pressurisation.

In various chemical production processes, for example, in the Deacon Process using inorganic molten salts for the direct oxidation of HCl to chlorine, molten salts have to be conveyed into a forced circulation system in order, for example, that they can be discharged over a large area in a trickling-film reactor under reaction conditions. The operating conditions, which require an operating temperature of about 500° C., are exacting; a particular problem of the above-mentioned process is the high corrosiveness of the KCl/CuCl melt, which permits only ceramic, for example quartz glass, to be used as reactor material.

Two types of process have hitherto been employed for the discharge of hot aggressive molten salts.

In the unpublished German Patent Application under the file number P 44 32 551.7 it is proposed, for example, that a molten salt be pumped by means of a full ceramic gear pump. The pump is driven magnetically coupled, with special attention having to be paid to the sealing between the pump region and the coupling region, in order that no molten salt can enter the coupling region, where it would cause damage through corrosion.

The disadvantage of this pump is moreover the high weight of the pump unit, which interacts with the relatively sensitive reactor unit.

In the unpublished German Patent Application, file number P 44 40 632.0 the pneumatic discharge of a molten salt is proposed as an alternative pumping process.

For this the sump of the reactor is subjected to periodically timed pressurisation by educt gas, so that the melt can be discharged via an ascending pipe into an overhead vessel, in order there to flow down again via the wetted-wall column into the reactor. A nozzle in the inlet to the sump renders possible the build-up of pressure and prevents an excessive bypass stream. The disadvantage of this process is the periodic pressurisation of the ceramic reactor vessel, as a result of which the vessel approaches its loading limit, with the danger of a leakage and the necessity of an overhead vessel to even out the flow of the molten salt.

The object was to construct a pumping device for aggressive liquids, in particular for molten salts, which does not have the disadvantages of the above-mentioned pumps.

It is to be possible to place the pump, in a manner comparable with a simple immersed pipe, into a storage vessel or reactor. The pump should contain as few structural elements as possible and operate largely without mechanical or externally electrically moving parts and should render pressurisation of the reactor unnecessary.

The object is achieved according to the invention by a device for the discharge of in particular hot, corrosive liquids, in particular molten salts, consisting of a pump pipe equipped with a gas inlet and a gas outlet, a discharge pipe for the liquid having an open end dipping into the liquid and optionally arranged coaxially to the pump pipe, and of at least two valves, with openings between pump pipe and discharge pipe being provided between the said valves, the valves being opened by the respective liquid flow and closing in the direction of gravity.

In a particular embodiment of the device, the use of different valves wherein the two valve closing parts are of differing density is advantageous for the smooth operation of the discharge. The closing part of the lower valve (inlet valve) should rise as easily as possible, in order to render possible the inward flow of the liquid (melt). It should have a density only a little more than that of the liquid to be discharged.

The closing part of the upper valve, however, should as far as possible open only during the actual discharging process and should otherwise close securely, in order to prevent a back flow of the fluid, for example a molten salt, during the recharging process. It must therefore have as high a density as possible. By way of example, for a potassium/copper chloride melt having a density of about 3 g/cm$^3$, a ball made of silicon nitrite having a density of 3.2 g/cm$^3$ for the lower valve and a ball of zirconium oxide having a density of 6 g/cm$^3$ for the upper valve are particularly suitable.

The pumping device according to the invention excels in comparison with other discharging devices owing to its simplicity. It can be operated with only two moving parts, namely the passively hydraulically opened valves. As the valves are operated throughout immersed in the molten salt, the pipe and the valve seat are always almost at the same temperature, so that secondary stresses, which might lead to the failure or fracture of the structural part, can be avoided particularly when the valve seat and the pipe are manufactured from the identical material, for example, quartz.

In addition to an upright embodiment in vertical operating position comprising pump pipe and discharge pipe, curved or laterally displaced arrangements in respect of the direction of the piping are also possible, so that the insertion thereof is highly flexible. It is necessary only that the respective valve seats are operated horizontally.

The particular advantage of the device according to the invention is that the function of the reactor vessel (for example, during a periodic pressurisation for the purpose of pneumatic discharge) can be completely separated from the function of the pump, so that the reactor vessel has, at most in the unpressurised condition, to ensure only the gastight enclosure of the liquid, for example, the melt.

Another particular advantage of the device according to the invention is that, despite an individual periodic mode of operation, it can provide for a continuous flow of molten salt through the reaction column when it is operated in chronological sequence in connection with at least one pumping device of the same kind in such a way that at least one pump is in the corresponding overlap in relation to time in the discharge mode.

By this means it is possible, for example, to dispense with a receiver for molten salt in the head region of the reactor, which clearly simplifies the construction of the latter. Moreover the nozzle between column and sump which is required for the pneumatic discharge can be omitted, so that a simple, continuously cylindrical reactor construction becomes possible.

The device according to the invention can be controlled via the gaseous phase completely decoupled from the molten salt, with the intervals being controllable either by timing or else by pressure.

The device according to the invention, by virtue of its simple cylindrical form, can also be guided through the packing of a packed column. If it is pushed through the packing zone through a guide pipe sealed at the top against an educt gas bypass, then it can be withdrawn as required without the packing being disturbed.

Optionally a sealable opening may be provided above the outlet valve, so that the melt in the discharge pipe can be discharged, for example, for purification purposes.

The discharge volume per cycle of the device according to the invention can be influenced by altering the depth of immersion in the sump and, in the construction, by altering the diameter of the pump pipe in proportion to the discharge pipe.

The discharge cycle can be shortened especially by improving the inlet conditions during the recharging phase. For this purpose, instead of the one inlet valve in the discharge pipe, a group of several valves arranged in a circle is provided in the base region of the pump pipe, and the discharge pipe at this level is closed at the bottom. Idle time during the recharging is kept short by this means.

Virtually any technically functional discharge heads can be achieved using this principle of the device according to the invention.

The invention will be illustrated in more detail by way of example with the aid of the Figures below.

Figure 2:
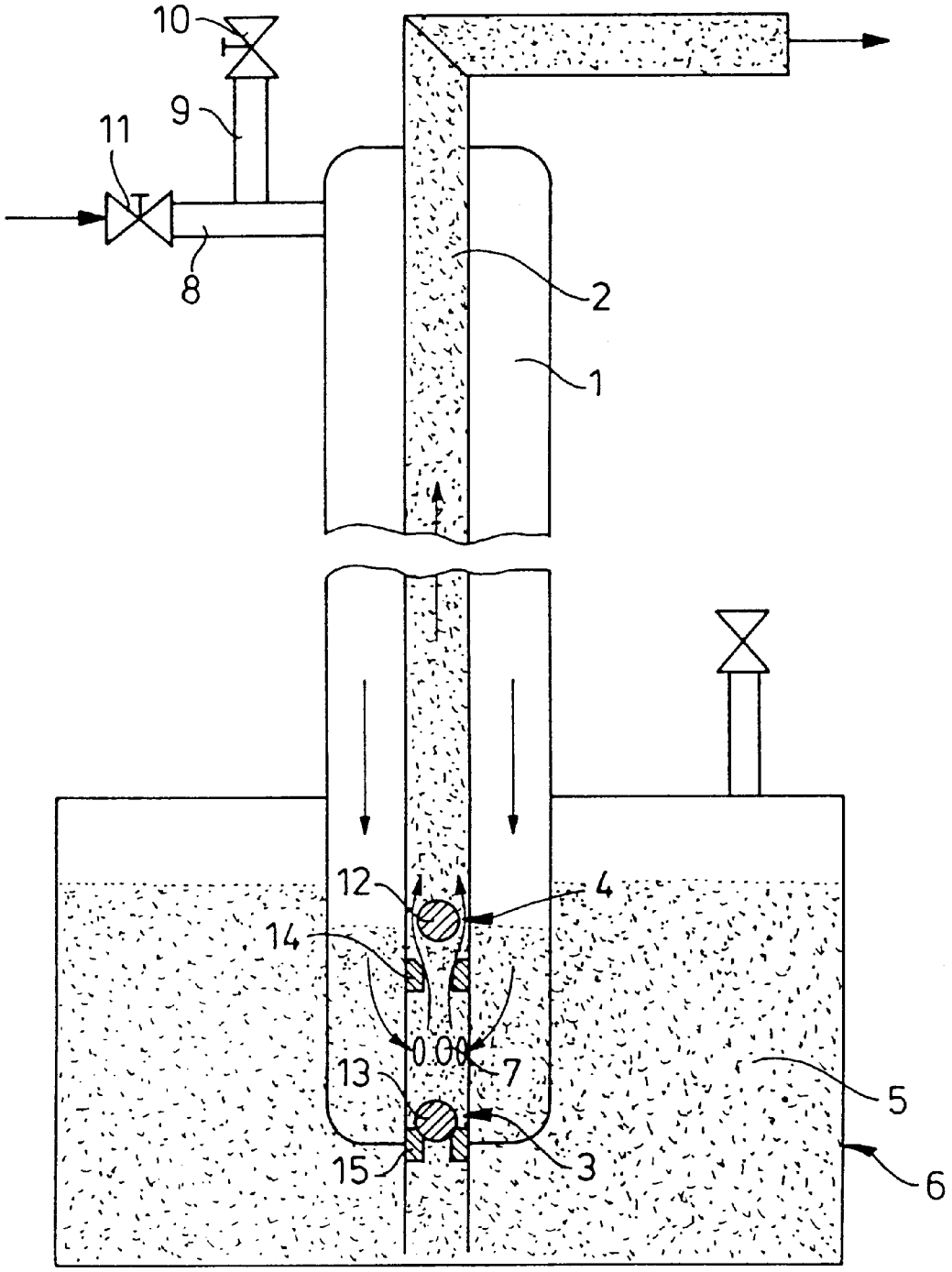
Figure 3:
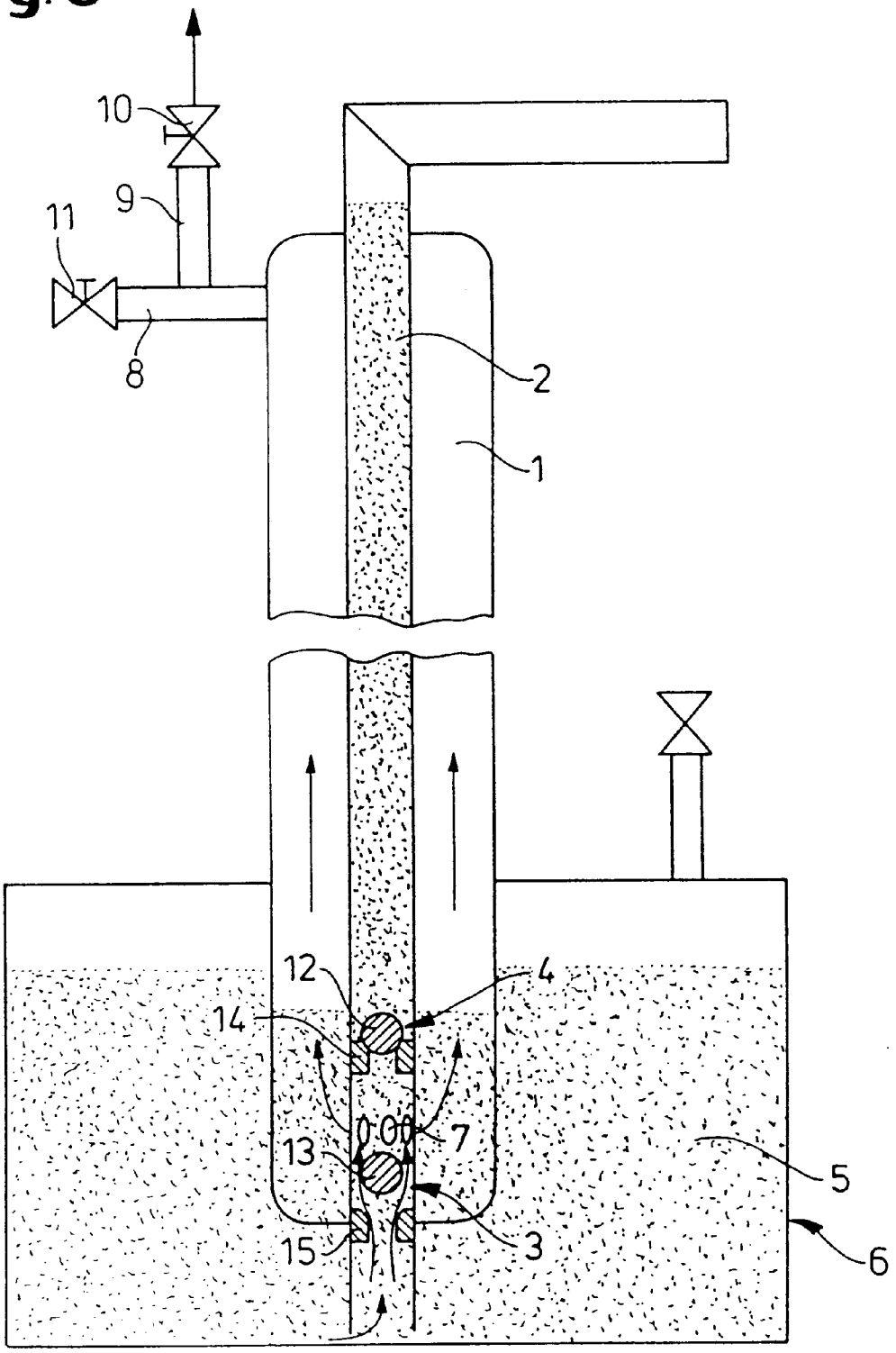
Figure 4:
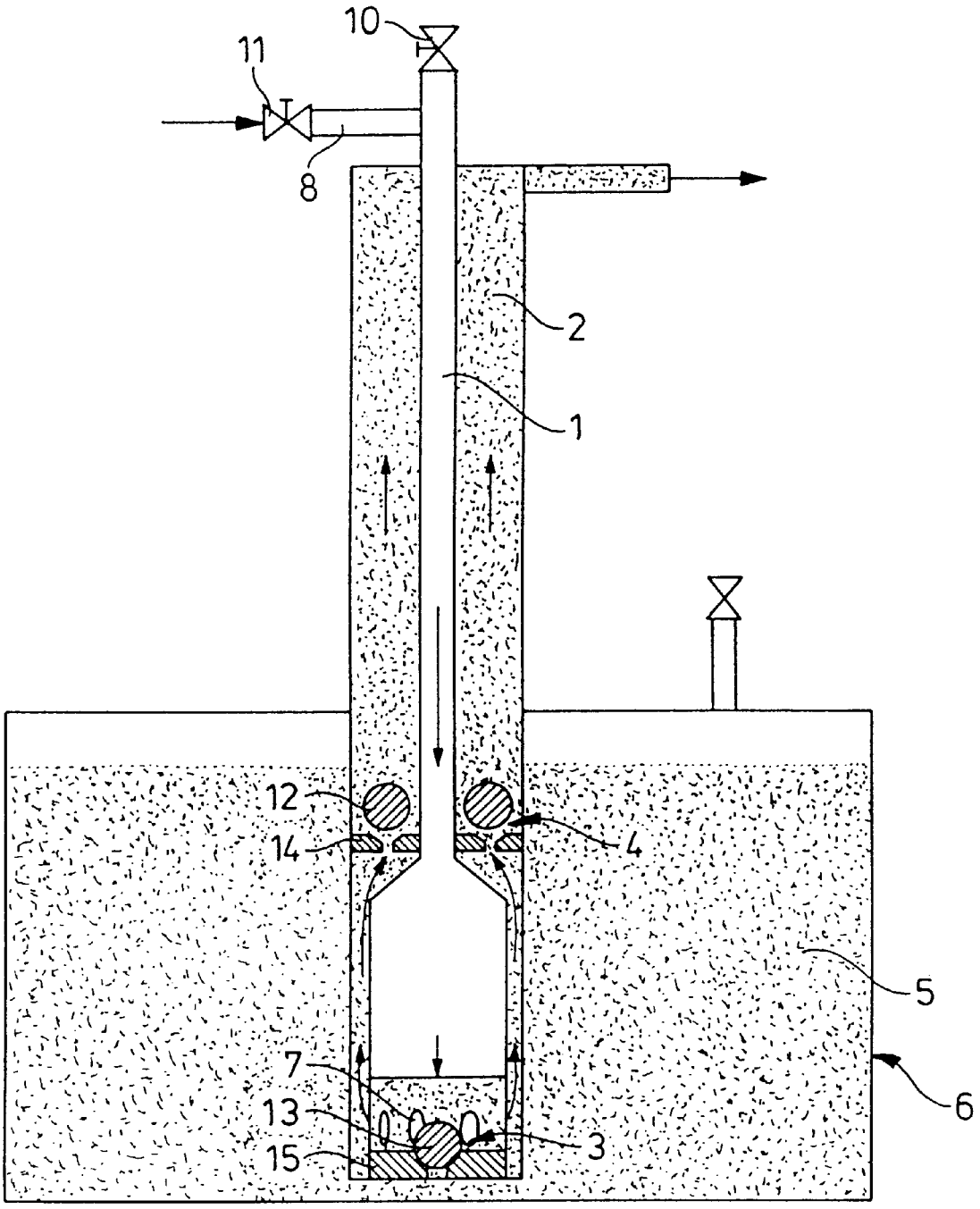

In the Figures:

FIG. 1 shows a diagrammatic section through a pump according to the invention during filling FIG. 2 shows the pump in FIG. 1 during discharge FIG. 3 shows the pump in FIG. 1 during refilling FIG. 4 shows a variant of the pump according to the invention, equipped with an external discharge pipe, during the discharge.

The discharging using the device according to the invention is carried out periodically. During the initial filling from the storage vessel 6 corresponding to FIG. 1, the two ball valves 3, 4 together with the balls 12 and 13 respectively and the valve seats 14 and 15 respectively are opened by the melt 5 flowing in from below into the discharge pipe 2; the vent pipe 9 and valve 10 on the side of the gas is open. For the discharging process in FIG. 2, the pumping gas, for example, the educt gas of a reaction is fed into the pump pipe 1 when the vent pipe 9 and valve 10 are closed and forces the melt 5 through the slit 7, further through the automatically opening upper ball valve 4 into the discharge pipe 2, until the pump pipe 1 has been emptied up to the level of the slit 7. For refilling, corresponding to FIG. 3, the supply of educt gas 8 is shut off at the valve 11 and the vent pipe 9 is open at the valve 10. The upper ball valve 4 is closed by the load thereon of the melt 5, while the lower valve 3 is pressurised by the pressure of the external melt and a refilling of the pump pipe 1 is made possible.

Alternatively, the arrangement of pump pipe 1 and discharge pipe 2 can also be reversed (see FIG. 4). By means of this arrangement the volume of gas required for the discharge can be particularly small and consequently the cycle time is particularly short. The advantage in this arrangement is a widening of the pump pipe 1 in the region close to the inlet almost to the internal diameter of the discharge pipe, in order, for example, to move an especially large amount of melt per discharge cycle.

EXAMPLE

The basic functioning of the pumping device according to the invention was tested in an experimental arrangement using as the test liquid zinc chloride hydrate (density: 2.0 g/cm$^3$). The test proceeded at room temperature. The test model had the following components and dimensions:

Pump pipe diameter: 80 mm

Discharge pipe diameter: 24 mm

Discharge head: 10 000 mm

Immersion depth: 600 mm

Inlet valve: 6 pieces, arranged in a circle

Ball diameter of the closing bodies: 5 mm

Ball material: silicon nitrite

Density: 3.2 g/cm$^3$

Free passage: 12 mm

Discharge valve 4

Ball diameter of the closing body: 15 mm

Ball material: aluminium oxide

Density: 3.9 g/cm$^3$

Free passage: 11 mm

Compensating bores: 6 pieces, 12 mm diameter

The test model showed the following performance data in operation:

Measured discharge pressure: 1 bar above hydrostatic pressure

Measured discharge cycle: 30 sec

Inlet time: 4 sec

Pumping process: 26 sec

Measured discharge volume: about 1 l/cycle

Using the pumping device described, approx. 120 l of melt could be discharged per hour. The idle time was about 13% (relative to the discharge time).

The closing parts shut so tightly that even after one day the melt had not escaped out of the discharge pipe.

In further tests using hot molten salts, a closing body made of zirconium oxide has proved successful.

We claim:

1. Device for the discharge of hot, corrosive liquids 5, consisting of a pump pipe 1 equipped with a gas inlet 8 and a gas outlet 9, a discharge pipe 2 for the liquid 5 having an open end dipping into the liquid 5 and optionally arranged coaxially to the pump pipe 1, and of at least two valves 3, 4, with openings 7 between pump pipe 1 and discharge pipe 2 being provided between the valves 3 and 4, the valves 3, 4 being opened by the respective flow and closing in the direction of gravity.

2. Device according to claim 1, wherein the pump pipe 1 is arranged coaxially inside the discharge pipe 2.

3. Device according to claim 2, wherein the pump pipe 1 is widened between inlet valve 3 and outlet valve 4 almost to the internal diameter of the discharge pipe 2.

4. Device according to claim 1, wherein the valves 3 and 4 are constructed as ball valves.

5. Device according to claim 1 wherein the closing parts 12, 13 of the valves 3 and 4 are of a differing density, with the density of the closing part 13 of the inlet valve 3 being a little more, in particular from 1 to 10% more, than the density of the liquid 5, and the density of the closing part 12 of the outlet valve 4 being significantly more, in particular at least 50% more, than the density of the liquid 5.

* * * * *